US009627766B2

(12) United States Patent
Mannan

(10) Patent No.: US 9,627,766 B2
(45) Date of Patent: Apr. 18, 2017

(54) HIGH GAIN ANTENNA WITH LOW DIRECTIONAL PREFERENCE

(71) Applicant: Michael Mannan, Harrow (GB)

(72) Inventor: Michael Mannan, Harrow (GB)

( * ) Notice: Subject to any disclaimer, the term of this patent is extended or adjusted under 35 U.S.C. 154(b) by 64 days.

(21) Appl. No.: 14/425,309

(22) PCT Filed: Sep. 3, 2013

(86) PCT No.: PCT/GB2013/052305
§ 371 (c)(1),
(2) Date: Mar. 2, 2015

(87) PCT Pub. No.: WO2014/033482
PCT Pub. Date: Mar. 6, 2014

(65) Prior Publication Data

US 2015/0295316 A1 Oct. 15, 2015

(30) Foreign Application Priority Data

Sep. 3, 2012 (GB) ..... 1215618.8

(51) Int. Cl.

| | |
|---|---|
| ***H01Q 1/24*** | (2006.01) |
| ***H01Q 9/04*** | (2006.01) |
| ***H01Q 1/00*** | (2006.01) |
| ***H01Q 1/40*** | (2006.01) |
| ***H01Q 9/28*** | (2006.01) |
| ***H01Q 19/00*** | (2006.01) |
| ***H01Q 19/10*** | (2006.01) |

(52) U.S. Cl.
CPC ..... *H01Q 9/045* (2013.01); *H01Q 1/007* (2013.01); *H01Q 1/24* (2013.01); *H01Q 1/40* (2013.01); *H01Q 9/285* (2013.01); *H01Q 19/005* (2013.01); *H01Q 19/108* (2013.01)

(58) Field of Classification Search
CPC ..... H01Q 9/045; H01Q 9/285; H01Q 19/005; H01Q 19/108
See application file for complete search history.

(56) References Cited

U.S. PATENT DOCUMENTS

| | | | |
|---|---|---|---|
| 5,943,025 | A | 8/1999 | Benham et al. |
| 6,160,514 | A | 12/2000 | Judd |
| 2006/0035588 | A1 | 2/2006 | Chapelle |

FOREIGN PATENT DOCUMENTS

| | | | |
|---|---|---|---|
| DE | 601 00 376 | T2 | 4/2004 |
| EP | 0698972 | A1 | 2/1996 |
| WO | WO-01/59881 | A1 | 8/2001 |
| WO | WO-01/84730 | A1 | 11/2001 |
| WO | WO-02/31908 | A2 | 4/2002 |
| WO | WO-02/33786 | A1 | 4/2002 |

OTHER PUBLICATIONS

International Search Report for PCT International Application No. PCT/GB2013/052305, Dec. 9, 2013, 4 pages.
Search Report for GB Application No. GB1215618.8, Jul. 26, 2013, 2 pages.

*Primary Examiner* — Hoang V Nguyen
*Assistant Examiner* — Michael Bouizza
(74) *Attorney, Agent, or Firm* — Fenwick & West LLP

(57) ABSTRACT

An antenna with a first pair of fed lands (3, 5) disposed on a first sheet of electrical insulating material in a first plane and a second pair of lands (11, 13) or a single second land disposed in a second plane is disclosed. The antenna provides a high gain with low directional preference.

14 Claims, 1 Drawing Sheet

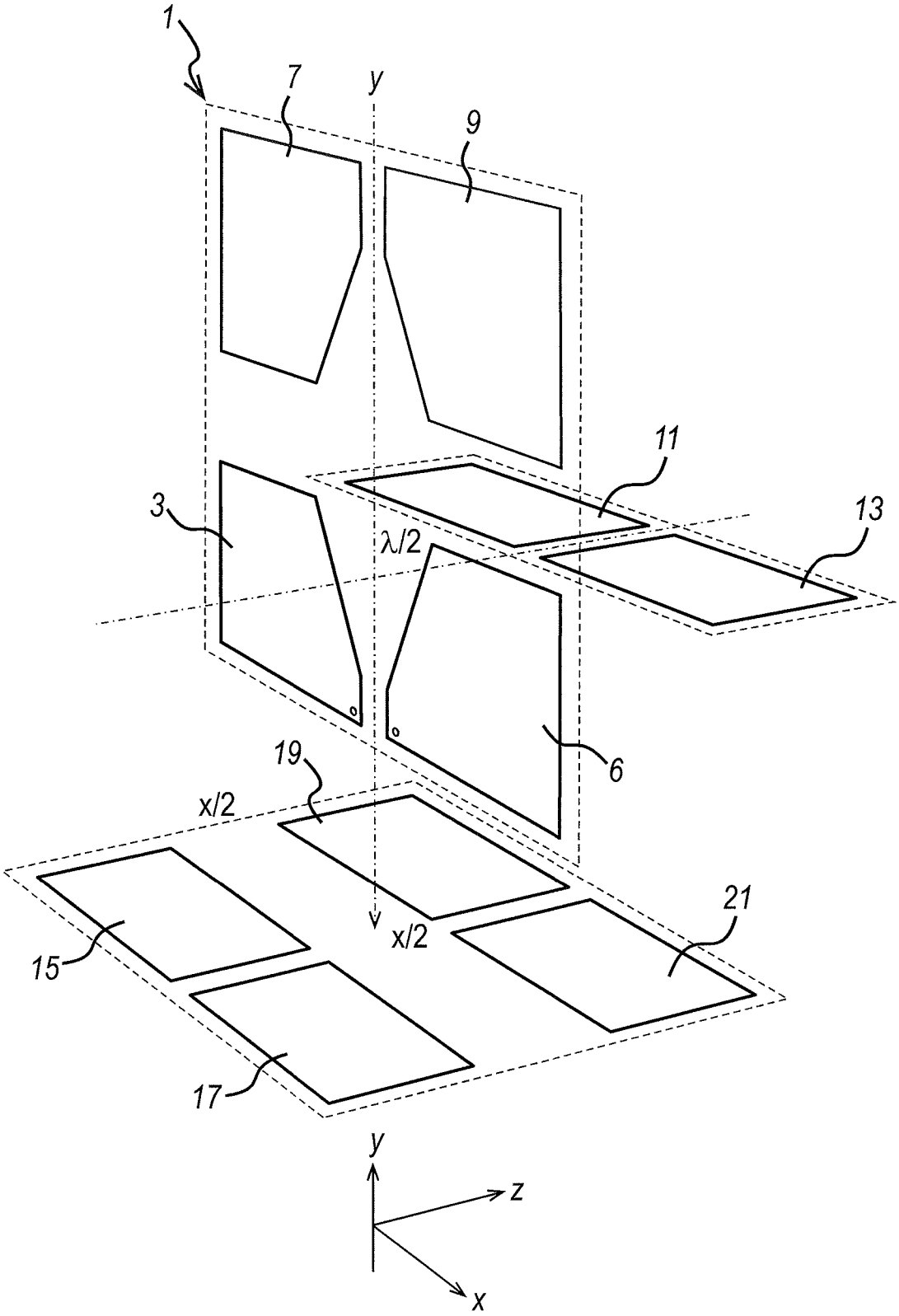
1
7
y
9
11
3
λ/2
13
6
19
x/2
21
x/2
15
17
y
z
x

HIGH GAIN ANTENNA WITH LOW DIRECTIONAL PREFERENCE

FIELD OF INVENTION

This invention relates to antennae. In one form it relates to an antenna which is particularly suitable for, but not limited to, receiving television signals. The invention is also applicable to antennae for radio transmission and reception.

BACKGROUND OF INVENTION

Conventional television antennae are generally quite bulky and unsightly. In order to achieve best performance, outdoor antennae are preferred, for example, roof mounted antennae. However, these can be inconvenient to mount securely, and difficult to maintain. In the event of a storm, an outdoor antenna may easily become misaligned, or it may suffer damage.

Indoor antennae are commonly smaller than outdoor antennae for aesthetic reasons. However, their small size limits their efficiency, which means that they are generally suitable for reception only in areas where the television signals are strong. A tuned Yagi antenna has additional elements to increase gain, but this achieves high gain only along the front-rear direction of the antenna. Thus the antenna is highly directional and is also susceptible to receiving rear-reflected signals to cause ghosting. Typically the acceptance angle of a Yagi antenna is only about 20 degrees.

The present invention is concerned with providing an antenna of planar elements of compact size, disposed in different planes with increased gain for domestic television reception and reduced directional preference.

According to the invention, there is provided an antenna as claimed in claim 1 or claim 23 hereinafter. This provides a high gain antenna which has a wide range of acceptance angles. Further features of the invention are set forth in the dependent claims.

When referring to planes, a first plane differs from a second plane through orientation of the first plane with respect to the second plane. A plane offset vertically or horizontally from and parallel to a plane is considered to be the same plane as the plane from which it is offset.

The planes on which the respective lands are disposed may be orthogonal for optimal gain across a wide range of acceptance angles.

The provision of further lands in one or more planes may optimise antenna performance.

The shape of each land may be configured to optimise performance. Disposal of the lands symmetrically about an imaginary line may improve performance.

The first pair of lands may be integrated with or within a television. The second pair of lands may be mounted on a television wall bracket or within or on a television stand. This allows the first and second lands to maintain their orientations with respect to one another, and to be obscured from view during use.

The sheet material may be flexible (e.g. of plastics material) or it may be relatively rigid, for example a stiff cardboard sheet.

The electrically conductive foil type lands may be formed by a variety of means (e.g. printing, laminating, etching, evaporation), but preferably they are formed of foil (e.g. aluminium foil) hot pressed onto the sheet material.

A preferred antenna according to the invention, for use with a domestic television receiver, will now be described by way of example with reference to the accompanying drawing. The drawing shows the antenna in perspective view.

The antenna comprises a sheet 1 of stiff cardboard in the XY plane to which has been laminated by hot foil blocking four spaced aluminium foil lands 3,5,7 and 9. The aluminium foil is approximately $200\times10^{-10}$ metres in thickness, which gives an electrical resistance of about 1.5 ohms per square. The foil is overcoated with an electrically-insulating lacquer.

The arrangement may be manufactured by sputtering aluminium to the desired thickness onto a lacquer-coated backing surface. The aluminium is then coated with adhesive and the combination hot foil blocked onto the sheet 1 with the adhesive adjacent the sheet. The backing surface is peeled away to leave the sheet 1, lands 3, 5, 7, 9 and lacquer overcoating bonded together.

Each pair of lands 3,5 and 7,9 is spaced apart from and is symmetrical about an imaginary line y-y on sheet 1.

The antenna also comprises additional lands 11, 13 disposed symmetrically about the imaginary line y-y in the XZ plane.

Lands 15, 17, 19, 21 may also be disposed in the XZ plane in addition to or in place of lands 11, 13. Lands 15, 17, 19, 21 are also disposed symmetrically about the imaginary line y-y. These lands may also be formed by laminating aluminium foil lands by hot foil blocking onto stiff cardboard. The aluminium foil is approximately $200\times10^{-10}$ metres in thickness, which gives an electrical resistance of about 1.5 ohms per square. The foil is overcoated with an electrically-insulating lacquer. The arrangement may be manufactured by sputtering aluminium to the desired thickness onto a lacquer-coated backing surface. The aluminium is then coated with adhesive and the combination hot foil blocked onto the sheet with the adhesive adjacent the sheet. The backing surface is peeled away to leave the sheet, lands 15, 17, 19, 21 and lacquer overcoating bonded together.

Lands 11, 13 are located approximately a distance of $\lambda/2$ from sheet 1 along the Z axis. Additional/alternative lands 15, 17, 19, 21 approximately a distance of $\lambda/2$ from sheet 1 along the Y axis. $\lambda$ is the wavelength of operation in the range of 500 to 900 MHz.

Feeds are taken from lands 3, 5 for obtaining a television signal in the range of 500 to 900 MHz.

The feed (not shown) to lands 3,5 preferably comprises a clip which presses a pair of strip conductors down onto the lacquer at adjacent corners of the lands 3,5. The contact to the aluminium foil is capacitive through the intervening lacquer (it can also be a direct metal-to-metal contact, without intervening lacquer). Alternative feeds are, of course contemplated and within the scope of the invention.

Lands 3,5 each have a maximum y-dimension of 20 cm and a maximum x-dimension of 20 cm. Lands 7,9 have a maximum y-dimension of 20 cm and a maximum x-dimension of 20 cm. At their closest approach lands 3,5 are spaced from lands 7,9 by 1 cm in the x-direction. Lands 3, 5 and 7, 9 are spaced-apart in the y-direction by 1 cm.

Lands 3, 5, 7 ,9 as shown may have a fully or partially tapered edge from the y side to the x side. The configuration of the tapered edge can be varied to optimise performance. Other configurations include substantially square or trapezoidal.

Lands 11, 13 each have a maximum x-dimension of 20 cm and a maximum z-dimension of 20 cm. Lands 15, 17, 19, 21 each have a maximum x-dimension of 20 cm and a maximum z-dimension of 20 cm.

Shorting the non-fed pair(s) of lands (7, 9, 11, 13, 15, 17, 19, 21) can improve band selectivity, and this can be achieved by shorting across a small area of exposed foil on each land.

In one embodiment, the antenna is designed for use through orientating the sheet 1 vertically within or on a television. Lands 11, 13 and 15, 17, 19, 21 preferably will be integrated with a television wall bracket and television stand respectively. Lands 11, 13 and/or lands 15, 17, 19, 21 are orientated with respect to sheet 1 in the range of 0 to 180°,preferably 45 to 135°,and most preferably 90°. When lands 11, 13 and/or lands 15, 17, 19, 21 are orientated orthogonally to sheet 1, they act as non-fed parasitic reflector lands along with lands 7, 9. It has been found that when lands 7, 9, 11, 13 and/or 15, 17, 19, 21 resonate in conjunction with the fed lands, an antenna with high gain and reduced directional preference is achieved.

Changing the planes in which the lands are located with respect to one another varies antenna output. For example, although lands 11, 13 and 15, 17, 19, 21 are disposed in the ZX plane, they may also be disposed in the XY plane. Alternatively, only lands 11, 13 may be disposed in the XY plane, or only lands 15, 17, 19, 21 may be disposed in the XY plane. In these arrangements, the lands 11, 13 and 15, 17, 19, 21 would be disposed along the imaginary line, but positioned so that they are symmetrical about the imaginary line. A greater or fewer number of lands can be used other than that shown to vary antenna output. Although, elements 3 and 5 are shown as the fed elements, in principle any or any combination of the lands shown can be fed.

In a further embodiment which is a variant of that illustrated, any or all of the land pairs 7 and 9, 11 and 13, 15 and 17, 19 and 21 are merged to form one contiguous land disposed symmetrically about the imaginary line y-y in the XZ plane, to act as parasitic reflectors to lands 3 and 5.

The shape and dimensions of the lands can be varied according to the frequency of operation to optimise antenna output at the frequency of operation.

Although the lands are described as being formed by laminating aluminium foil lands by hot foil blocking onto stiff cardboard, it is possible to use lands in the form of thin electrically conductive materials such as aluminium manufactured to present as foil type lands. In addition the foil type lands can be manufactured from microwave materials by selecting a material with the appropriate properties such as dielectric constant, thickness and conductor type. Hence, use of the word foil is used to mean both lands formed from a foil and lands formed in other ways which present similarly in the form of foil type elements. Lands of these types may also be integrated with a television, television wall bracket and/or television stand. The structure of these lands makes it practical to deploy the elements internally and/or externally on the television, television wall bracket and/or television stand.

It will be appreciated that this description is by way of example only; alterations and modifications may be made to the described embodiment without departing from the scope of the invention as defined in the claims.

The invention claimed is:

1. An antenna comprising:

a first pair of electrically conducting lands disposed in a first plane, the first pair of electronically conducting lands being symmetric about, and spaced apart from an imaginary line;

antenna feed means comprising feeder elements for each land of the first pair of electrically conducting lands;

at least one a second electrically conducting parasitic land and a second pair of parasitic lands disposed in a second plane and electrically insulated from the first pair of electrically conducting lands, at least one of the second electrically conducting parasitic land and the second pair of parasitic lands being symmetric about the imaginary line; and at least one of:

at least one of a third pair of parasitic lands and a third single parasitic land disposed in the same plane as the first pair of electrically conducting lands, the at least one of the third pair of parasitic lands and the third single parasitic land being spaced apart from the first pair of electrically conducting lands, being electrically insulated from the first pair of electrically conducting lands, and being symmetric about the imaginary line: and at least one of a fourth pair of parasitic lands and a fourth single parasitic land disposed in the second plane, the at least one of the fourth pair of parasitic lands and the fourth single parasitic land being spaced apart from at least one of the second electrically conducting parasitic land and the second pair of parasitic lands, being electrically insulated from at least one of the second electrically conducting parasitic land and the second pair of parasitic lands, and being symmetric about the imaginary line.

2. The antenna of claim 1, wherein the first and second planes are orthogonal.

3. The antenna of claim 1, wherein the first pair of lands is disposed within or on a television receiver.

4. The antenna of claim 1, wherein the at least one of the second electronically conducting parasitic land and the second pair of parasitic lands is disposed on a television receiver wall mount, and wherein the at least one of the second electronically conducting parasitic land and the second pair of parasitic lands and the at least one of the fourth pair of parasitic lands and the fourth single parasitic land are disposed within or on a television stand.

5. The antenna of claim 3, wherein the at least one of the second electronically conducting parasitic land and the second pair of parasitic lands is disposed on a television receiver wall mount within or on a television stand.

6. The antenna of claim 5, wherein the at least one of the third pair of parasitic lands and the third single parasitic land is disposed within or on a television receiver.

7. The antenna of claim 6, wherein the at least one of the fourth pair of parasitic lands and the fourth single parasitic land is disposed within or on a television receiver wall mount or within a television stand.

8. The antenna of claim 7, wherein each land is generally rectangular or trapezoidal.

9. The antenna of claim 8, wherein at least one of the first pair of electrically conducting lands and at least one of the second electrically conducting parasitic land and the second pair of parasitic lands comprises foil lands disposed in a respective first or second plane on a respective first or second sheet of electrical insulating material having an electrically-insulating coating thereover.

10. The antenna of claim 9, wherein at least one of the at least one of the third pair of parasitic lands and third single parasitic land and the at least one of the fourth pair of parasitic lands and the fourth single parasitic land comprises foil lands disposed in the respective first or second plane on the respective first or second sheet, or a respective third or fourth sheet of electrical insulating material having an electrically-insulating coating thereover.

11. The antenna of claim 10, wherein the feeder elements capacitively couple to the respective lands.

12. The antenna of claim 11, wherein the feeder elements comprise a clip for attachment to the sheet material and for urging the feeders into the capacitive coupling arrangement to the respective lands.

13. The antenna of claim 1, comprising both the at least one the at least one of the third pair of parasitic lands and the third single parasitic land, and the at least one of a fourth pair of parasitic lands and a fourth single parasitic land.

14. An antenna comprising:

a first pair of electrically conducting lands disposed in a first plane on a first sheet of electrical insulating material, the first pair of electrically conducting lands being symmetric about, and spaced apart from an imaginary line on the first sheet of electrical insulating material;

antenna feed means comprising feeder elements for each land of the first pair of electrically conducting lands;

at least one a second electrically conducting parasitic land and a second pair of parasitic lands disposed in a second plane and electrically insulated from the first pair of electrically conducting lands, at least one of the second electrically conducting parasitic land and the second pair of parasitic lands being symmetric about the imaginary line on the first sheet of electrical insulating material; and at least one of:

at least one of a third pair of parasitic lands and a third single parasitic land disposed on the first sheet of electrical insulating material, the at least one of the third pair of parasitic lands and the third single parasitic land being spaced apart from the first pair of electrically conducting lands, being electrically insulated from the first pair of electrically conducting lands, and being symmetric about the imaginary line; and at least one of a fourth pair of parasitic lands and a fourth single parasitic land disposed in the second plane, the at least one of the fourth pair of parasitic lands and the fourth single parasitic land being spaced apart from the at least one of the second electrically conducting parasitic land and the second pair of parasitic lands, being electrically insulated from the at least one of the second electrically conducting parasitic land and the second pair of parasitic lands, and being symmetric about the imaginary line.

* * * * *